US005775140A

United States Patent [19]

Hallsten

[11] Patent Number: 5,775,140

[45] Date of Patent: Jul. 7, 1998

[54] LOCK FOR CASSETTES FOR THE CONSTRUCTION OF DRAWER CABINETS

[75] Inventor: Lars Olof Hallsten, Taby, Sweden

[73] Assignee: Borgstroms Platindustri AB, Kilafaors, Sweden

[21] Appl. No.: 646,350

[22] PCT Filed: Oct. 18, 1994

[86] PCT No.: PCT/SE94/00973

§ 371 Date: May 10, 1996

§ 102(e) Date: May 10, 1996

[87] PCT Pub. No.: WO95/13726

PCT Pub. Date: May 26, 1995

[30] Foreign Application Priority Data

Nov. 16, 1993 [SE] Sweden ..... 9303797

[51] Int. Cl.[6] ..... E05B 65/46; E05C 19/10

[52] U.S. Cl. ..... 70/85; 70/77; 292/128; 292/228

[58] Field of Search ..... 70/85, 77; 292/126, 292/128, 226, 228, 336.3

[56] References Cited

U.S. PATENT DOCUMENTS

| | | | |
|---|---|---|---|
| 970,661 | 9/1910 | Stoddard | 292/128 |
| 1,082,408 | 12/1913 | Conard | 292/128 |
| 1,126,700 | 2/1915 | Bull | 292/128 |
| 1,638,547 | 8/1927 | Myers | 292/128 |
| 1,874,289 | 8/1932 | Haskins et al. | 292/128 |
| 2,010,492 | 8/1935 | Karre | 292/126 |
| 2,251,138 | 7/1941 | Knight | 292/128 |
| 3,031,248 | 4/1962 | Jeeves . | |
| 3,161,923 | 12/1964 | Crain | 292/128 |
| 3,208,781 | 9/1965 | Appleberry | 292/128 |
| 3,288,508 | 11/1966 | Maize et al. | 292/128 |
| 3,455,590 | 7/1969 | Zerfoss | 292/128 |
| 3,918,751 | 11/1975 | Blake | 292/126 |
| 4,401,350 | 8/1983 | Fortune | 312/107 |
| 5,292,191 | 3/1994 | Slivon | 312/332.1 |

FOREIGN PATENT DOCUMENTS

| | | | |
|---|---|---|---|
| 1293004 | 4/1962 | France | 292/126 |
| 630283 | 5/1936 | Germany . | |
| 1003082 | 2/1957 | Germany | 292/126 |
| 3905843 | 9/1989 | Germany . | |
| 540752 | 10/1941 | United Kingdom | 292/128 |
| 2216398 | 10/1989 | United Kingdom . | |

*Primary Examiner*—Steven N. Meyers
*Assistant Examiner*—Tuyet-Phuong Pham
*Attorney, Agent, or Firm*—Young & Thompson

[57] ABSTRACT

A lock for a cabinet cassette having a drawer comprises a frame structure which carries on one hand a locking bar (47) passing through an opening (50) in a frontal part (23) of drawer, said bar being turnable and projecting from the inside of said frontal part (23), and on the other hand a handle connected to the bar. At least one fixed projection (54) is connected to the frame structure, said projection projecting from the back side of the frontal part, the locking bar (47) being, by turning the handle (48), movable between on one hand a locking turned-up position in which the bar engages behind an upper vertical flange (16) of the frontal frame (6) of the cassette and on the other hand a liberating turned-down position in which the bar is located below the upper side (55) of the projection (54).

8 Claims, 3 Drawing Sheets

LOCK FOR CASSETTES FOR THE CONSTRUCTION OF DRAWER CABINETS

TECHNICAL FIELD OF THE INVENTION

The present invention relates to a lock for cassettes of the type intended for the construction of drawer cabinets, each of which cassettes accomodates a drawer and comprises on one hand a rectangular frontal frame from which four walls extend, viz. a bottom wall, two side walls and an upper wall, and on the other hand a rear wall to which said walls are connected, and which frontal frame has substantially vertically positioned flanges in connection with said walls, the drawer in addition to a rear part comprising a bottom part, two side parts and a frontal part, which, along an upper edge, presents a longitudinal, forwardly projecting gripping flange having a hook- or hitchlike cross-sectional profile.

PRIOR ART

A cassette for a drawer cabinet of the sort generally described above is previously known from DE-A-3 905 843. In its basic embodiment, the cassette is provided with four male-like members on its underside, in the form of hook-shaped plates or sheet portions intended to be inserted and locked in cooperating holes in the upper side of a subjacent cassette. The cassettes are commercially available in different embodiments, in particular in embodiments with different heights, thereby enabling the user to erect drawer cabinets adapted to individual needs in a quick and flexible way. In the known cassette for drawer cabinets, the drawer is normally arranged to be guided by two guide rails which are placed on both sides of the drawer adjacent to on one hand each side wall and on the other hand the bottom wall. According to this embodiment, the drawer is retained in its position within the cassette by two projecting members which are formed on the underside of the bottom part of the drawer, in the vicinity of the frontal part of the drawer, in order to be locked behind a lower part of the frontal frame of the cassette as long as the drawer rests upon the cooperating guide rails. Only when lifting the frontal end of the drawer, so that the projecting members pass clear of the lower part of the frontal frame, the drawer can be pulled out to an outer end position. In its maximally pulled-out position, the drawer is retained in the cassette by an upper edge portion of the rear part of the drawer that engages behind an upper part comprised in the frontal frame of the cassette. For a complete removal of the drawer from the cassette, the frontal portion of the drawer is turned in an upward direction when the drawer is in the region of its maximally pulled-out position.

A disadvantage of the above-mentioned cassette is the necessity of lifting the drawer upwardly when it should be pulled out from its inner end position. In order to make such movements possible the opening in the frontal frame of the cassette has to be palpably wider than the drawer itself. For this reason the guidance of the drawer will be inaccurate. Among other things there will be a risk that the drawer bounces when it is subjected to shock movements, for instance if the cabinet is mounted in a vehicle or another mobile unit. The prior art arrangement of locking the drawer makes it further impossible to subsequently mount roller guide rails having an accurate guidance of the drawer.

Objects and Features of the Invention

The present invention aims at eliminating the abovementioned disadvantages of the previously known construction and provide a lock which is capable of retaining the drawer in its fully pushed-in position in the cassette without calling for a lifting of the drawer relative to the cassette when liberating and pulling the same out. Accordingly, a primary object of the invention is to provide a simple and cheep lock which on one hand in its locking position safely retains the drawer in its inserted position in the cassette and on the other hand, by a simple manipulation, liberates the drawer without calling for a lifting thereof relative to the cassette. In other words the drawer should be able to be pulled out to an outer end position by a simple linear pulling movement. Another object of the invention is to provide a lock which in a smooth manner adopts itself to the conventional shape of the drawers of the known cassettes. Still another object of the invention is to provide a lock which has a long useful life even in the case when the cabinets erected by the cassettes are used in tough environments, for instance in vehicles in which the drawers of the cabinets are subjected to frequent shock movements during ride.

According to the invention at least the primary object thereof is attained by the features defined in the character rising clause of claim 1.

BRIEF DESCRIPTION OF THE ATTACHED DRAWINGS

In the drawings:

FIG. 1 is a simplified perspective view illustrating a drawer cabinet in a first embodiment, built up of several cassettes containing drawers, FIG. 2 is an analogous perspective view showing another embodiment of such a drawer cabinet, FIG. 3 is a perspective view of an individual cassette with the appurtenant drawer shown in a pushed-in position, FIG. 4 is a perspective exploded view with the drawer separate from the cassette and with a number of the guide rails shown in connection with the drawer, FIG. 5 and 6 are vertical sections of a lock included in the drawer, shown in two different functional positions, and FIG. 7 is an exploded view showing the lock according to the invention separate from the corresponding frontal part of the drawer.

In FIG. 1 reference numeral 1 designates individual cassettes which are stacked into a drawer cabinet which is designated by 2 in its entirety. As may be seen in FIG. 2, the lowermost cassette 1 may be mounted on a special bottom frame 3 which is suited for being connected to the underlying floor or support. The uppermost cassette of the drawer cabinet may be covered by a special cover plate 4 or by a longer table which may be supported on two or several drawer cabinets (not shown).

In FIGS. 3 and 4, reference numeral 5 generally designates the drawer that is included in each cassette 1. The cassette 1 as such is composed of a frontal frame, in its entirety designated 6, which delimits a frontal opening 7 for the reception of drawer 5, and a rear part, in its entirety designated 8. This rear part comprises two side walls 9, 9' and a rear wall 10. In practice, the rear part 8 may be made of one single continuous, suitably thin-walled piece of sheet-metal which is punched out of a material and is bent into a U-shape as seen in a cross-section as well as in contour. More precisely, by this shape both upper horizontal flanges 11 and lower, equally horizontal flanges 12 are formed along each one of walls 9, 9' and 10. Said upper flanges 11 are situated in a common plane and form an upper wall or part of the cassette 1. In an analogous way, also the lower flanges 12 are situated in a common horizontal plane and form a lower wall or part of the cassette. The free ends of the U-profiles that are formed by side walls 9, 9' embrace the frontal frame 6 and are connected to it in a suitable manner, for instance by spot welding or pressing. Advantageously, also frontal frame 6 is made of thin sheet-metal which is given a U-shaped cross-section by punching and bending. In FIG. 4 reference numeral 13 designates an upper part, 14 a bottom part and 15,15' vertical side parts included in said frontal frame. Each one of these four front parts 13, 14, 15 and 15' comprises a vertically positioned flange 16. Along the lower flanges 12 of the side walls 9,9' sheet-metal plates 17 of L-formed cross-section are arranged which form fixed guide rails of standard character for the drawer 5. Thus, in its standard embodiment drawer 5 is movable forwardly and backwardly along guide rails 17 while being guided by the vertical flanges 18 of the guide rails.

Further, in FIGS. 3 and 4 may be seen that the bottom side of each cassette is provided with four male-like projections 19 in the form of hook-shaped sheet-metal tabs which can be brought into engagement with corresponding, elongate holes 20 in the upper flanges 11 of a subjacent cassette. When male projections 19 have been brought into engagement with holes 20 and two connected cassettes have been placed so that they are located in register with each other in one and the same vertical plane, then the cassettes may be locked relative to each other by a locking member 21 in the form of a thread-like finger the free end of which may be brought into engagement with an analogous hole 22 via an elongate hole in the horizontal web of frontal bottom part 14, hole 22 being in the horizontal web of the frontal upper part in each subjacent cassette. Any horizontal dislocation of the cassettes relative to each other is impeded by locking finger 21, thus safely joining the cassettes and forming a form-stable drawer cabinet.

Referring to FIG. 4, it should be noted that drawer 5 in addition to a frontal part, which is designated 23 in its entirety, comprises a bottom part 24, two side parts 25, 25' and a rear part 26. Together, these components form a substantially parallelepipedical drawer. It should be noted that the frontal part or frontal plate 23 is larger than the rear part 26 which is only slightly smaller than the frontal opening 7, whereby frontal part 23 will substantially completely cover the rearwardly located frontal frame 6 when the drawer is in its pushed in position. Moreover, it should be noted that the frontal part 23 of the drawer has a longitudinal, forwardly projecting gripping flange 27 along its upper edge, the cross-section of the flange having a hook- or hitch-like profile.

The cassette construction described so far is substantially the same as the one disclosed in DE-A-3 905 843.

FIG. 4 further illustrates a kit comprising two pairs of guide rails 28,28' and 29,29' which are formed as supplements that are mountable when required, and which include rollers for accurately guiding the drawer.

DETAILED DESCRIPTION OF A PREFERRED EMBODIMENT OF THE INVENTION

Figure 5:
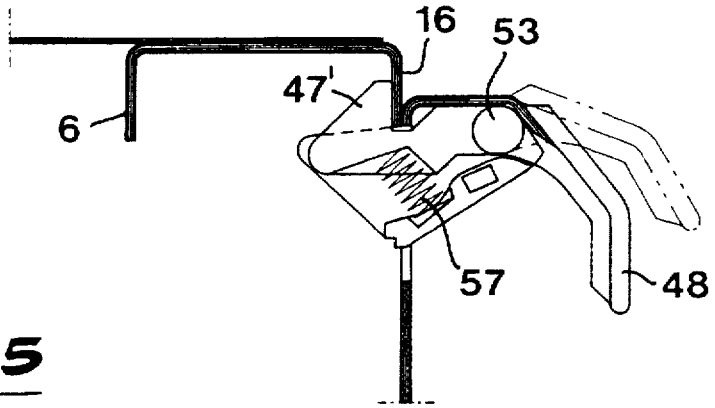
Figure 6:
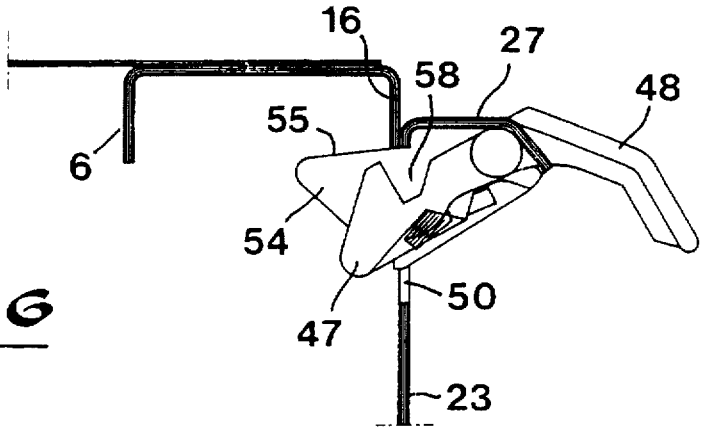
Figure 7:
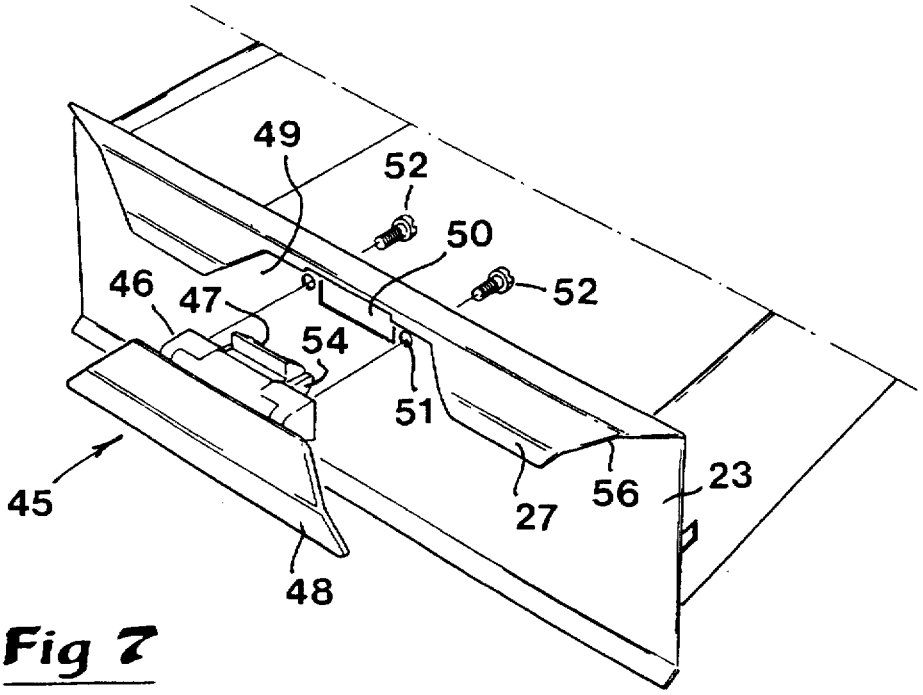

In FIGS. 5 to 7 reference numeral 45 generally designates a lock made according to the invention. This lock comprises a frame structure 46 intended to be fastened on the outside of frontal part 23 of the drawer 5. A locking bar 47 is hingedly connected to frame structure 46, said bar in its turn being connected to a handle 48. As may be clearly seen in FIG. 7, a recess or cut-in portion 49 is provided in the central portion of gripping flange 27. This recess 49 exposes on one hand a substantially rectangular opening 50 placed near under the upper edge of the frontal part 23 and on the other hand two diminutive orifices 51 intended for fastening screws 52, which are tightenable in threaded holes in the back or inner side of frame structure 46. A pivot pin 53 is included in frame structure 46, this pivot pin being common for the handle 48 and the locking bar 47. Projections 54 are provided on both sides of locking bar 47 and pass, like bar 47, through the opening 50 and protrude from the backside of frontal part 23. Each of these two projections has a substantially plane upper surface 55.

It should be noted that the cross-sectional shape of handle 48 substantially corresponds with the hook- or hitch-like cross-sectional shape of the fixed gripping flange 27 on frontal part 23. The length of handle 48 substantially corresponds to the length of recess 49, whereby the handle will cover or over-bridge recess 49 after mounting on frontal part 23. In this way, a continuous unit is formed along the upper edge of the frontal part by the handle and the two fixed portions of gripping flange 27 being separated by recess 49. It may also be noted that end edges 56 of gripping flange 27 are shortened or cut-in so that the two upper corner portions of frontal part 23 are exposed. In this way it is possible to place a spot welding element near under the upper corner areas of the gable part for making spot weld joints between the frontal part and the two side parts 25,25' of the drawer.

Referring to FIGS. 5 and 6, it should also be noted that at least one spring 57 operates between the frame structure 46, which is fixedly mounted on the gable part, and the hingedly movable locking bar 47 and/or handle 48. It should also be noted that locking bar 47 is hook-shaped in that it has a nose 47' pointing upwards from a horizontal portion.

The described lock functions in the following way. In the locking position, as shown in FIG. 5, nose 47' of the locking bar 47 engages behind the upper, vertical flange 16 on the frontal frame 6 of the cassette. In this state, the handle 48, which is rigidly or stiffly connected to the locking bar, is turned down into a lower end position. When the lock is to be opened in order to enable a pulling of drawer 5 outwardly, then the user grips the handle 48 and turns it upwardly around the pivot axis 53 (the turning angle is about 30° to 350°) into the position shown in FIG. 6. Thereby, locking bar 47 will be turned down to a position in which the upper portion of nose 47' will be located at a level beneath the plane upper surfaces 55 of projections 54. In this way, the drawer becomes liberated to be pulled out of the cassette, this being effected by a user conferring to handle 48, by hand, a linear, horizontal pulling motion while the handle is continuously held in its uplifted position. Thereafter, the drawer may be pulled out to an outer end position at which the upper edge of rear part 26 abuts against frontal frame 6.

Also when pushing of the drawer inwardly into the cassette, the user holds handle 48 in its uplifted position, however while applying on the handle a pressing force by which the drawer is pushed into the cassette. When frontal part 23 has reached contact with frontal frame 6, then the handle is left hold of and the spring or springs 57 automatically return locking bar 47 to its locking position as shown in FIG. 5. Thereby, handle 48 automatically returns to its turned-down position, in which it adjoins to the two fixed portions of gripping flange 27. In practice, the bottom surface 58 that is provided behind nose 47' of the bar in its locking position may be located at a certain distance below upper surfaces 55 of projections 54. In this way, the locking bar will only come into contact with the backside of flange 16 of the frontal frame, but not with the lower edge of flange 16. This means that the bar 47 as such is not submitted to life-reducing stress, for instance because of shock-like movements of the kind that may arise when a drawer cabinet is mounted in a vehicle or another mobile unit. Hence, such shock-like movements are taken up by projections 54.

In this context it should also be mentioned that projection surfaces 55 in practice may lean in a direction frontwards-downwards when seen in the pushing-in direction, in order to facilitate the insertion of the projections beneath upper flange 16 of the frontal frame.

Figure 2:
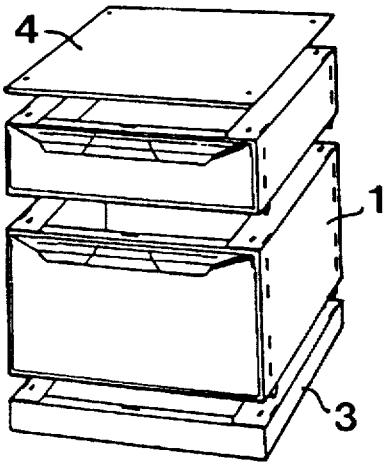
Figure 1:
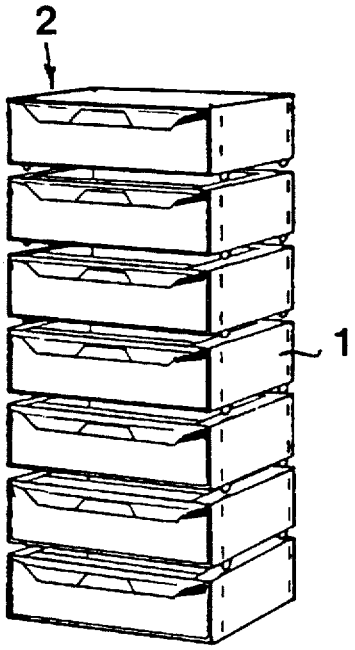
Figure 3:
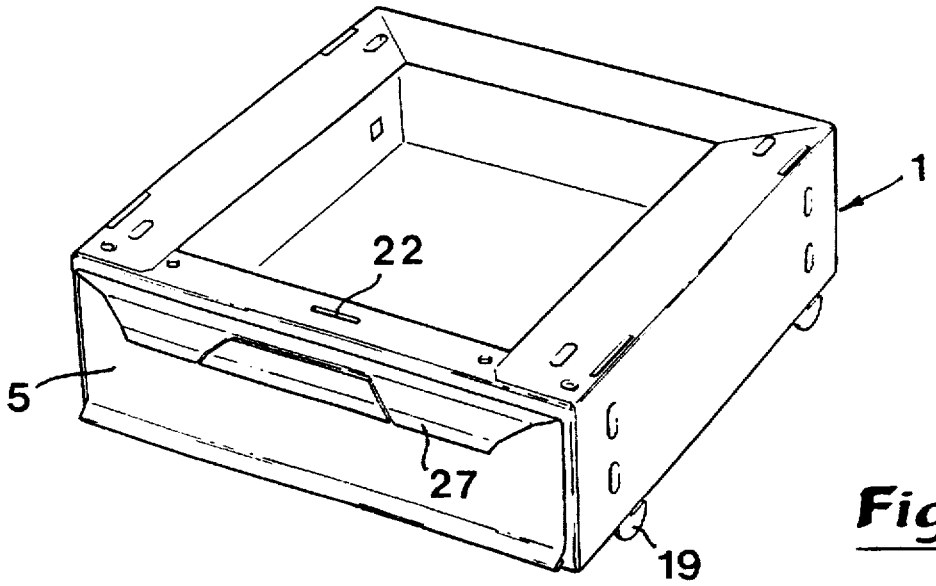
Figure 4:
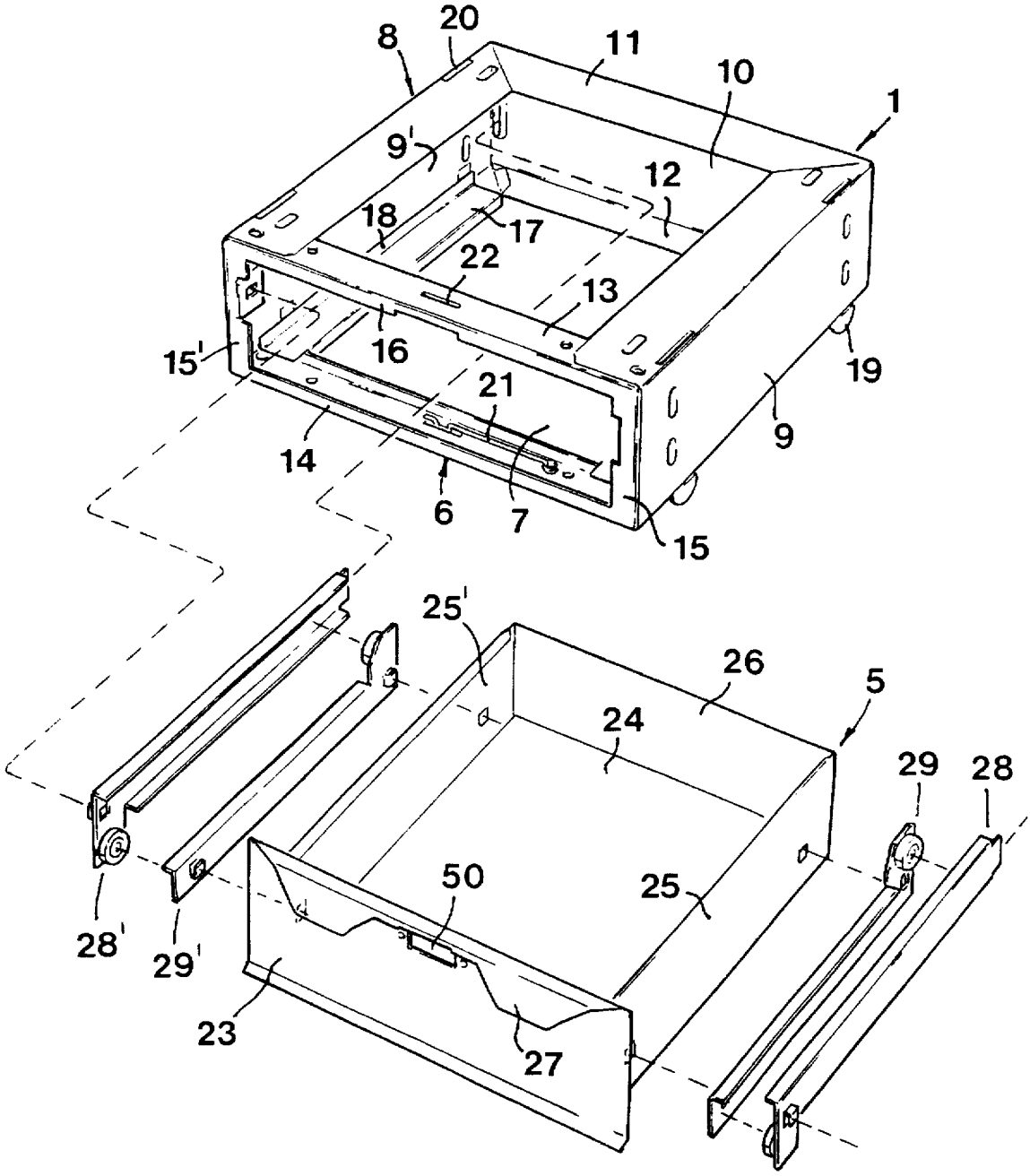

The advantages of the lock according to the invention are evident. Thus, the lock in question allows pushing the drawer in and pulling the same out by a purely linear displacement motion, i.e., without the necessity of lifting the drawer in order to liberate it; this in turn enabling a more precise guiding of the drawer, for instance by means of the guide rails 28, 29 shown in FIG. 4. Furthermore, the lock is simple and cheap and it corresponds well to the shape of the gripping flange 27 in general, thanks to the special form of handle 48. Therefore, an observer and/or user will not experience that the drawer in question constitutes a drastical exception relative to conventional drawers, in spite of the fact that it includes the special lock.

I claim:

1. A cassette and drawer combination of the type intended for the construction of drawer cabinets, comprising (a) a cassette which comprises on one hand a rectangular frontal frame from which four walls extend including a bottom wall, two side walls and an upper wall, and on the other hand a rear wall to which said four walls are connected, and which frontal frame has substantially vertically positioned flanges in connection with said walls, and (b) a drawer adapted and arranged to slide in and out of said cassette and comprising a rear part, a bottom part, two side parts and a frontal part, said frontal part comprising a frontal wall having an upper edge and a longitudinal, forwardly projecting gripping flange extending from said upper edge and having a hook-or hitch-shaped cross-sectional profile, a length of said gripping flange comprising a cut-in portion forming a recess provided in at least one, suitably central part of the gripping flange, a fastening frame structure being fixedly mounted on an outside surface of the frontal wall adjacent said central part of the gripping flange, said frame structure carrying on one hand a turnable locking bar that extends through an opening in the frontal wall, said locking bar projecting into the drawer from an inside surface of the frontal wall, and on the other hand a handle connected to the locking bar, the profile shape of the handle substantially corresponding to the profile of the gripping flange and the handle substantially covering said recess in the gripping flange, and in that at least one projection is connected to the frame structure, said projection, like the locking bar, extending through the opening into the drawer and projecting from the inside surface of the frontal wall, the locking bar being pivotally mounted to the frame structure and movable by turning the handle between on one hand a locking, up-turned position in which the locking bar engages an inner surface of an upper, vertically positioned flange of the frontal frame of the cassette and extends above an upper surface of the projection, and on the other hand a liberating, down-turned position in which the bar disengages the inner surface and is positioned beneath the upper surface of the projection.

2. The cassette and drawer combination according to claim 1, wherein two projections are connected to said frame structure, one projection being positioned on each side of the locking bar.

3. The cassette and drawer combination according to claim 2, wherein the locking bar and the handle is loaded by at least one spring which always tends to urge the locking bar to its locking position and against the action of which the locking bar is, by means of the handle, turnable to its liberating position under the projection or projections.

4. The cassette and drawer combination according to claim 2, wherein the locking bar or the handle is loaded by at least one spring which always tends to urge the locking bar to its locking position and against the action of which the locking bar is, by means of the handle, turnable to its liberating position under the projection or projections.

5. The cassette and drawer combination according to claim 1, wherein the locking bar and the handle is loaded by at least one spring which always tends to urge the locking bar to its locking position and against the action of which the locking bar is, by means of the handle, turnable to its liberating position under the projection or projections.

6. The cassette and drawer combination of claim 1 wherein said locking bar comprises a hooked nose, said hooked nose extending above said upper surface and engaging said inner surface of said upper, vertically positioned flange of said frontal frame of said cassette in said locking, up-turned position, and said hooked nose extending below said upper surface and disengaging said inner surface of said upper, vertically positioned flange in said liberating, down-turned position.

7. The cassette and drawer combination of claim 6 wherein said hooked nose includes a cut-in segment which includes a first surface engaging said inner surface of said upper, vertically positioned flange of said frontal frame of said cassette in said locking, up-turned position and disengaging said inner surface of said upper, vertically positioned flange in said liberating, down-turned position, a second surface which extends in front of an outer surface of said upper, vertically positioned flange in said locking, up-turned position and said liberating, down-turned position, and a bottom surface which extends from said first surface to said second surface, said bottom surface of said cut-in segment being (a) positioned below said upper surface of said projection and (b) out of contact with said inner surface of said upper, vertically positioned flange in said locking up-turned position and said liberating, down-turned position.

8. The cassette and drawer combination according to claim 1, wherein the locking bar or the handle is loaded by at least one spring which always tends to urge the locking bar to its locking position and against the action of which the locking bar is, by means of the handle, turnable to its liberating position under the projection or projections.

* * * * *